US008998225B2

(12) United States Patent
Magee

(10) Patent No.: US 8,998,225 B2
(45) Date of Patent: Apr. 7, 2015

(54) BUSHING SECUREMENT DEVICE

(71) Applicant: Thane Magee, San Diego, CA (US)

(72) Inventor: Thane Magee, San Diego, CA (US)

( * ) Notice: Subject to any disclaimer, the term of this patent is extended or adjusted under 35 U.S.C. 154(b) by 0 days.

(21) Appl. No.: 14/078,492

(22) Filed: Nov. 12, 2013

(65) Prior Publication Data

US 2014/0131966 A1 May 15, 2014

Related U.S. Application Data

(60) Provisional application No. 61/724,723, filed on Nov. 9, 2012.

(51) Int. Cl.

| | |
|---|---|
| ***B62M 1/00*** | (2010.01) |
| ***A63C 17/01*** | (2006.01) |
| ***A63C 17/00*** | (2006.01) |

(52) U.S. Cl.

CPC ..... *A63C 17/012* (2013.01); *A63C 17/0093* (2013.01); *A63C 17/015* (2013.01)

(58) Field of Classification Search

CPC ... A63C 17/01; A63C 17/012; A63C 17/0093
USPC ..... 280/11.25, 11.27, 11.28, 87.042, 86; 411/383; 403/224
See application file for complete search history.

(56) References Cited

U.S. PATENT DOCUMENTS

| | | | | |
|---|---|---|---|---|
| 4,071,256 | A * | 1/1978 | Kimmell | 280/11.28 |
| 4,311,319 | A * | 1/1982 | Snyder et al. | 280/11.28 |
| 4,398,734 | A * | 8/1983 | Barnard | 280/11.28 |
| 5,879,013 | A * | 3/1999 | Shih | 280/11.28 |
| 6,315,312 | B1 * | 11/2001 | Reyes et al. | 280/11.28 |
| 6,367,819 | B1 * | 4/2002 | Andersen et al. | 280/11.28 |
| 6,428,023 | B2 * | 8/2002 | Reyes et al. | 280/11.28 |
| 6,467,782 | B1 * | 10/2002 | Smith | 280/11.28 |
| 6,474,666 | B1 * | 11/2002 | Andersen et al. | 280/87.042 |
| 6,793,224 | B2 * | 9/2004 | Stratton | 280/87.042 |
| 6,945,542 | B2 * | 9/2005 | Stewart | 280/87.042 |
| 7,007,957 | B1 * | 3/2006 | Lee | 280/11.28 |
| 7,093,842 | B2 * | 8/2006 | Chmelar | 280/87.042 |
| 7,104,558 | B1 * | 9/2006 | Saldana | 280/87.042 |
| 2001/0038187 | A1 * | 11/2001 | Reyes et al. | 280/87.042 |
| 2004/0066014 | A1 * | 4/2004 | Stewart | 280/87.042 |
| 2004/0145142 | A1 * | 7/2004 | Wang | 280/87.042 |
| 2006/0097470 | A1 * | 5/2006 | Chmelar | 280/87.042 |
| 2010/0327547 | A1 * | 12/2010 | Wilson et al. | 280/87.042 |
| 2013/0308887 | A1 * | 11/2013 | Gesmer | 384/523 |

* cited by examiner

*Primary Examiner* — Paul N Dickson
*Assistant Examiner* — Robert A Coker
(74) *Attorney, Agent, or Firm* — Donn K. Harms

(57) ABSTRACT

A skateboard bushing securement system is provided for improvement of skateboard truck stability and performance. Base washers having a raised annular ring are positioned on opposite sides of bushings engaged to the truck hanger. The annular rings are sized to engage around the circumference of the bushings. Sleeve washers having axially located projecting sleeves communicate against the base washers during compression. The projecting sleeves engage inside the axial cavity of the bushings on both sides of the hanger. Stability and performance is enhanced through the stabilization of both bushings axially and about their circumference by the annular rings.

12 Claims, 2 Drawing Sheets

BUSHING SECUREMENT DEVICE

This application claims priority to U.S. Provisional patent application Ser. No. 61/724,723 filed on Nov. 9, 2012, and is included herein in its entirety by this reference thereto.

BACKGROUND OF THE INVENTION

1. Field of the Invention

The present invention relates generally to skateboards. More particularly, the device and method herein, when employed as the disclosed component or components, or when using the method herein, provides a means for user-customization and enhancing riding performance of the skateboard. This enhancement in performance and comfort is provided by an enhanced securement of a shock absorbing bushing to the truck assembly, and employment of such as a means for adjusting riding characteristics of the ride of the board such as the pre-load and rebound. The disclosed device may be used to retrofit existing skateboard truck assemblies, or may be included and provided as components of an entire improved truck assembly.

2. Prior Art

Skateboard trucks and their engagement to skateboards have generally, as an art, advanced little in recent years. Conventionally, a skateboard truck comprises a hanger assembly supporting an axle which provides a rolling engagement for wheels. The truck engages the overhead skateboard through the employment of a baseplate.

The hanger is typically engaged to a baseplate through operative engagement of a central bolt or pin, conventionally called a kingpin. Also employed in this axial arrangement are top and bottom positioned, resilient shock absorbing bushings or pads. These bushings are conventionally located on opposite sides of the hanger.

To secure the hanger to the baseplate, a nut is employed which may be selectively tightened or loosened to adjust the compressive forces impacted on the bushings axially engaged upon the bolt on the opposing sides of the hanger. This tightening or loosening of the nut to expand or contract the axial length, provides a means for tuning a pre-loading of the compression of the bushings which also affects the rebound characteristics of the bushings. The pre-loading, so accomplished, also affects the steering of the skateboard since the rider must tilt to compress the bushings which will resist, depending on the pre-loading. Additionally, ride and performance characteristics of the skateboard can be adjusted through a calculated pre-loading to provide a measured resistance to rider tilt or axial rotation of the engaged skateboard during steering. Other truck configurations are also known which are modified versions of this compressive tuning of the bushings using nut rotation.

However, as in many sports with different participants, different skateboarding styles have different steering and performance needs. Thus, riders are often making real-time adjustments as needed for the track, anticipated tricks, or other upcoming anticipated ride characteristic requirements for the rider or user. For example, a slalom skateboarder executing a serpentine route through pylons, will have different turning and performance needs than a street skateboarder who may wish to make quick turns followed by slides across a long pipe or handrail. Such ride requirements will additionally differ for the downhill skateboarder who will be trying for speed on straight runs and maintaining their board on the track during high speed turns.

However, in spite of many ride and performance requirements that different riders or the same rider might have in different venues, there exists no device or method on the market which considers all the performance needs of varying skateboarding styles and venues, and accommodates adjustments to fit any of those needs using a single system for adjusting the tuning and performance characteristics of the rider's skateboard in real time or as needed.

A conventional rubber or polymeric bushing is substantially donut-shaped and has a central axial passage for axial engagement of the bushing around the bolt serving as the kingpin. Such bushings are typically formed from polyurethane, however other materials are known and used. Some bushings are frustoconical in shape with narrowing sidewalls, and referred to as cone bushings, while others are substantially cylindrical in shape with straight sidewalls, referred to as barrel or chubby bushings. Manufacturers also provide these conventional bushings in sizes which vary the height and diameter of these bushings to achieve other characteristics.

Further, it is known in the art to employ planar metal or stiff washers in between the top bushing and baseplate, and the bottom bushing and the compressive nut. These washers reduce some of the wear and tear on the endwall of the bushings resulting from compressive forces of turning the skateboard, and the turning of the nut itself.

However, as many skateboarders well know, extended use and/or over tightening of the hanger to the baseplate by over tightening the nut on the kingpin can cause the bushings to settle into a bulge from full height, crack and wear out. This bushing degradation typically negatively effects the turning and riding characteristics of the skateboard for the rider to the point where turning is substantially inhibited, which can be quite dangerous. Further, any clearance between the axial passage of the bushing, and the circumference of the kingpin can cause the bushing to shift, rotate or translate around the kingpin. This axial migration of the bushing additionally negatively effects the real time turning and riding characteristics of the skateboard. Slipping can result in less then desired resistance to the axial rotation of the mounted board during turns, or if the bushing is damaged, too much resistance to turning can occur.

As a result of these shortcomings, there exists in prior art vain attempts to provide added securement of the bushings to the truck assembly, and therefor improve riding characteristics of the skateboard. One conventional solution is to employ cupped washers both between the top bushing and baseplate and the bottom bushing and nut. The cupped washer essentially hugs against or over the diameter of the bushing at the ends of the bushings which provides some added securement and resistance to bulging and cracking. However, cupped washers still fail to provide the substantial securement of the bushings at mid section areas and in their axial engagement to the kingpin and as such the skateboard may still have some performance downfalls.

Due to these continued shortcomings in the art of adjustable bushing support and engagement to skateboard trucks, there is a continuing unmet need for a skateboard bushing tuning and adjustment device and method that yields a system which provides the rider a means for added securement of the bushing to the truck assembly. Such added securement should do so in a manner which reduces or eliminates the bushing's current problem of translating relative the kingpin axis. Such a device and system should preferably be modular and employ components which are interchangeable for fine tuning purposes to provide users a means for adjusting the preload and rebound of the bushings beforehand or during a riding session at a venue which is easily employed, manufactured and is cost effective.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

It is another object of the present invention to provide a modular system for configuring and adjusting the bushing positioning and compressive engagement on a skateboard truck, or to provide entire skateboard truck assemblies which include the device herein.

It is a further object of this invention to provide such a system which allows users to easily adjust the ride characteristics of their skateboard, for the venue or anticipated riding conditions.

These and other objects, features and advantages of the present skateboard bushing system and method invention, as well as the advantages thereof over existing prior art, which will become apparent from the description to follow, are accomplished by the improvements described in this specification and hereinafter described in the following detailed description which fully discloses the invention, but should not be considered as placing limitations thereon.

SUMMARY OF THE INVENTION

The device and method of employment herein disclosed and described provides a solution to the shortcomings in prior art of skateboard bushing securement for trucks and achieves the above noted goals through the provision of a bushing securement device employing an interchangeable and modular washer system. The components disclosed herein, may be employed with conventional truck assembly components to yield an improved truck assembly sold as a unit, or may be provided for inclusion by users into existing truck assemblies in retrofit fashion. In accordance with one preferred mode, the device includes one or a plurality of cupped base washer components in combination with a plurality of interchangeable flat and sleeved washer components.

The sleeved washers are preferably formed from metal and have an axially-aligned cylindrical protrusion projecting therefrom which has an axial passage communicating therethrough. The plurality of flat washers preferably can include some metal washers such as steel or brass or aluminum and some non-metal washers of polymeric material such as polyurethane or other resilient material such as rubber or neoprene.

In addition, and particularly preferred, the planar metal and sleeved washers preferably have one or a plurality of annular ribs surrounded by depressions, disposed on at least one contact surface positioned to communicate against a bushing. This rib and recess configuration provides a means for enhanced gripping or engagement of the endwall of the bushing in the as-used mode, described below, and prevents bulging and axial wandering.

In general, in the as-used mode of bushing and washer configuration, the cupped base washer is configured to engage one or a combination of sleeved washers and flat washers, and/or the endwall of a conventional bushing, all in an axially aligned engagement upon and encircling the kingpin of the truck assembly. It is noted that the washer and bushing combination of the device can be employed on one or both of the top and bottom bushings conventionally employed on skateboard truck assemblies.

Whether used with special bushings or conventional bushings, the washer herein improves performance. The exterior diameter of the cylindrical axially projecting sleeve is sized to communicate within and engage with the interior surface defining the axial passage of the conventional bushing. So positioned, the projecting sleeves provide a rigid support to the endwall and axial passage intersecting the endwall of the bushing.

So configured, in the as-used mode engaged axial upon the kingpin, the sleeved washer provides a means for added securement of the bushing to the kingpin, and to substantially reduce the occurrence of the bushing shifting normal to the axis of the kingpin, or translating about the kingpin, when riding the skateboard. Further, the planar ribbed contact surface provides a means for enhanced gripping of the both the flat and sleeved washers to the endwall of the bushing for further enhancing the securement of both ends of the bushing from deformation, bulge, and translation and therefor performance of the bushing.

It is noted that the cupped base washers, sleeved washers, and flat washers can vary in size, thickness, and diameter as needed for employment with the variety of conventional diameters and sizes of bushings known in the art. For example, a cone bushing is known to be substantially smaller than a barrel bushing. Therefor the device preferably includes sets of base washers, sleeved washers, and flat washers which are sized for a registered engagement with the known diameters of cone and other conventional configurations of skateboard truck bushings.

In at least one preferred mode, the device is providable as a kit, including a plurality of sets of cupped base washers, sleeved washers and flat washers, each sized to the known dimensions of conventional bushings employed with skateboard truck assemblies. This provides the user with a modular kit of components which can be readily interchanged and employed for bushing securement for any type bushing. If desirable, the kit could also include bushings of varying compressive resistance to allow adjustment thereof in combination with the components of the kit.

Using conventional or kit bushings, rebound and pre-load characteristics of the assembled truck assembly can be selectively adjusted and fine tuned through the employment of the non-metal flat washer components preferably formed from resilient polyurethane. In the as used mode, the non-metal flat washers are preferably engaged between the cupped washer and either the flat metal washer or sleeved washer. The polyurethane washer essentially provides added shock absorbency and other characteristics which can be selectively employed in the device as needed to adjust rebound and pre-load. Those skilled in the art will recognize that the thickness and material of the flat washer can be selectively chosen to provide different rebound and pre-load characteristics as needed.

Further, in yet another preferred mode of the device and system, a universal cupped base washer may be provided. The universal washer includes cascading annular sidewalls each of decreasing diameter which are configured to engaged the varying sizes of flat and sleeved washers of the device. Therefor, another preferred kit is providable to the user comprising the universal cupped washer and a plurality of sets of sleeved washers and metal and non-metal flat washers.

With respect to the above description, before explaining at least one preferred mode of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

As used in the claims to describe the various inventive aspects and embodiments, "comprising" means including, but not limited to, whatever follows the word "comprising". Thus, use of the term "comprising" indicates that the listed elements are required or mandatory, but that other elements are optional and may or may not be present. By "consisting of" is meant including, and limited to, whatever follows the phrase "consisting of". Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements.

Further, as noted above, additional objects, features, and advantages of the invention will be brought out in the following part of the specification, wherein detailed description is for the purpose of fully disclosing the invention without placing limitations thereon.

BRIEF DESCRIPTION OF DRAWING FIGURES

The accompanying drawings, which are incorporated herein and form a part of the specification, illustrate some, but not the only or exclusive, examples of embodiments and/or features. It is intended that the embodiments and figures disclosed herein are to be considered illustrative rather than limiting. In the drawings.

DETAILED DESCRIPTION OF THE PREFERRED EMBODIMENTS OF THE INVENTION

Figure 1:
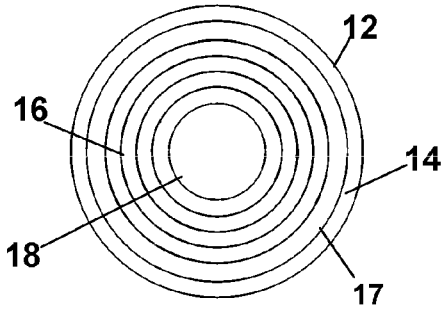
FIG. 1 shows a top view of a preferred mode of the cupped base washer.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 2:
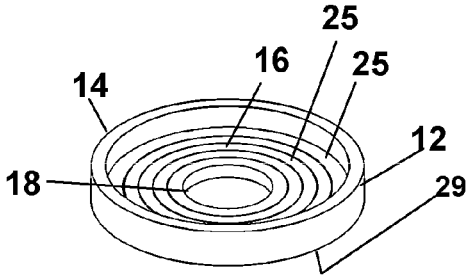
FIG. 2 shows a perspective view of cupped washer of FIG. 1.
Figure 3:
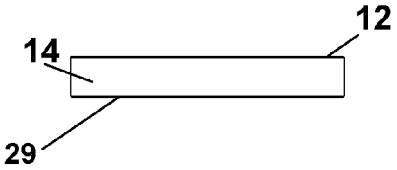
FIG. 3 shows a side view of the cupped washer of FIG. 1.

Now referring to drawings in FIGS. 1-13, wherein similar components are identified by like reference numerals, there is seen in FIG. 1, FIG. 2, and FIG. 3 views of a preferred mode of the cupped base washer 12 having a planar first surface 29 opposite a second surface having raised sidewalls 14 forming a plurality of annular planar surfaces 25 which reduce in elevation to form a stepped surface. A central axial aperture 18 communicates between the first surface 29 and second surface. Also shown are a plurality of annular gripping ribs 16 having opposing edges 17 abutting recesses or rises on opposite sides, which provide a means for enhanced gripping to the endwall 101 of bushings 108, 110 employed in a skateboard truck assembly 100 (FIG. 9), if the cupped base washer 12 is employed without the metal sleeved washer 34 noted below.

If employed with the metal sleeved washer 34 described below, the first surface 29 of the metal sleeved washer 34 has a diameter defined by the exterior wall communicating between the first and second surfaces which is sized to match that of one of any one of the annular planar surfaces 25 to provide a mount thereto when positioned within the raised side surface defining the particular planar surface 25 of matching diameter. When provided in a kit, or in combinations, the sleeved washers 34 can be provided with different diameters of the first side surface 29, which match one or a plurality of the diameters of the plurality of different elevations of the individual planar annular surfaces 25, and thereby position the sleeved washer 34 closer to or further from, the bushing when the first surface 29 of the sleeved washer 34 settles onto the annular surface 25 with matching diameter.

Figure 4:
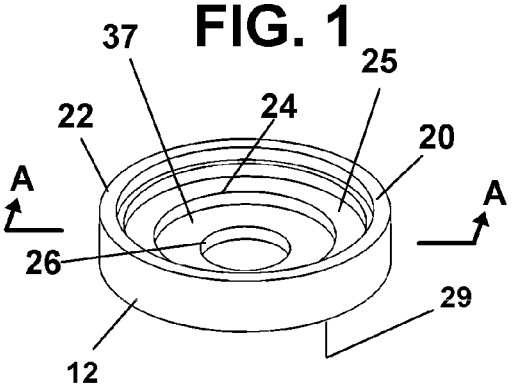
FIG. 4 shows a perspective view of a preferred mode of the universal cupped washer.
Figure 5:
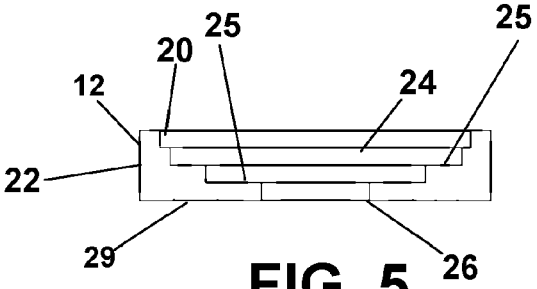
FIG. 5 shows a cross sectional view of the universal washer along line AA of FIG. 4.

FIG. 4 and FIG. 5 show view of another preferred mode of the universal cupped base washer 12 also having the planar first surface 29 and on the opposite or second surface, a raised perimeter sidewall 22 having an interior edge 20 defining a diameter inside an annular ring portion projecting away from the base washer 12 which is defined by the annular sidewall 22. Also shown are the plurality of declining stepped sidewalls 24 having decreasing diameters which define the diameters to the outside edges of the plurality of annular planar surfaces 25 declining in elevation above or away from the second surface 37.

A central axial aperture 26 is also provided communicating between the first surface 29 and second surface 37. It is noted that the diameter and thickness of the washer 12 and sidewalls 22, 24 can be modified as needed for varying sized bushings 108, 110 or varying endwall 101 diameters.

The cupped base washer 12 is preferred with the raised sidewall 22 rising above the highest located step defining a planar annular surface 25 adjacent to the sidewall 22. The diameter of the recess formed between the inside surfaces 20 of the sidewall 22 is preferably equal to, or slightly smaller than, the exterior circumference of the bushing 108 or 110 at the endwall 101 to provide a contacting circumferential engagement thereof to reduce or eliminate movement traverse to the axis of the kingpin by the bushing 108 or 110.

Figure 6:
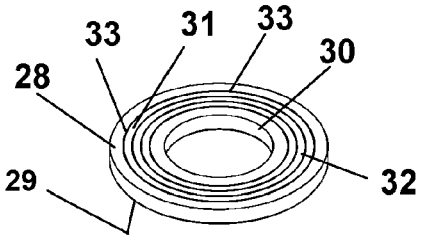
FIG. 6 shows a perspective view of a preferred mode of the flat preferably metal washer having annular gripping ribs.

FIG. 6 shows a view of a preferred mode of a planar, preferably metal washer 28 having a first surface 29 and a central aperture 30, and a plurality of annular gripping ribs 30 surrounding the aperture 30 decreasing in size as they near the aperture 30. The raised ribs 30 have an annular surface 31 which is raised at a central portion and declines toward each side edge 33 of each annular rib 30. Again, the diameter and thickness can be of the designers choice as needed to match the endwall 101 or other surface to be engaged.

Figure 7:
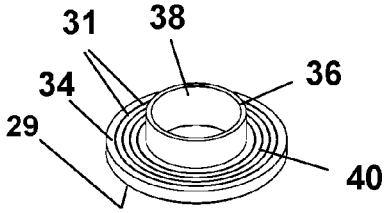
FIG. 7 shows a perspective view of a preferred mode of the sleeve washer also having annular gripping ribs.
Figure 9:
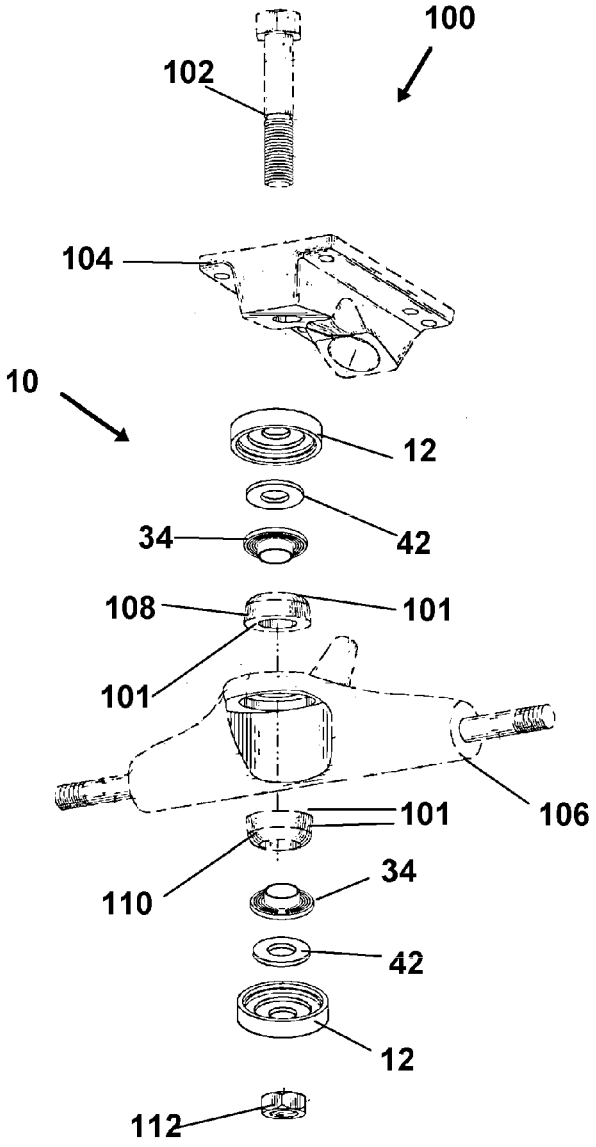
FIG. 9 shows an example of a preferred as used mode of the device engaged to a conventional skateboard truck assembly.
Figure 10:
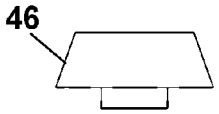
FIGS. 10-13 show views of a preferred mode of a top cap component of the device.
Figure 11:
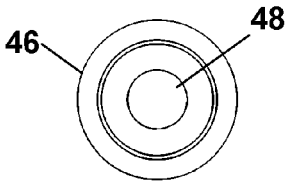
Figure 12:
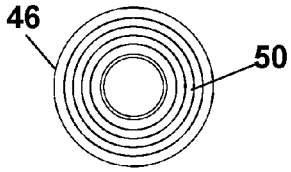
Figure 13:
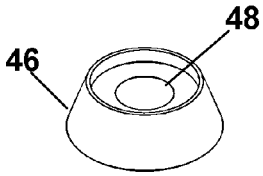

FIG. 7 shows a view of a preferred mode of a sleeve washer or metal sleeved washer 34. The sleeved washer 34 has a substantially planar first surface 29 and a central cylindrical sleeve portion 36 or annular sleeve portion, which projects away from the opposite or second surface. A central passage 38 communicates through the body of the sleeved washer 34. A plurality of annular gripping ribs 40 are also provided. The ribs 40 preferably may have raised central annular surfaces 31 as in FIG. 6, or stepped elevations of the annular surfaces 31, decreasing in elevation as they get closer to the central passage 38, forming a plurality of stepped annular surfaces as shown in FIG. 2. However, the raised annular surfaces 31 have shown to perform more securely to mount and secure the bushing by compressed engagement of the raised annular surfaces 31 into the planar endwall 101 of bushings if employed without the conventional flat washer. As shown in FIG. 9, the first surface 29 of the metal sleeved washer 34, engages against the stepped side of the cupped washer 12.

Figure 8:
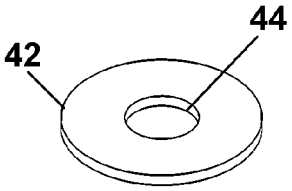
FIG. 8 shows a perspective view of a preferred mode of the flat preferably non-metal washer.

FIG. 8 shows a view of the preferred non-metal planar washer 42, formed from polyurethane or other polymeric or resilient material suitable for the intended purpose.

FIG. 9 shows an example as-used mode of the bushing securement device 10 herein, provided as a unit for use to retrofit, or in combination with the conventional skateboard truck assembly 100 as an improved truck assembly 100.

The device 10 may be provided with the baseplate, kingpin, nut, and bushings to form a complete truck assembly, or as components which may be used by engagement to an existing conventional truck assembly 100 to improve such. Both modes are anticipated within the scope of this patent.

Such truck assembly 100 generally consists of a kingpin 102, baseplate 104, hanger 106, top bushing 108, bottom bushing 110, and securement nut 112. However, it is noted that the device 10 can be employed with known variations of the conventional truck assembly and is anticipated.

In the as-used mode shown, either as part of a truck assembly or as added components to improve an existing truck assembly, the device 10 in a preferred mode, is shown configured with the cupped base washer 12, non-metal washer 42, and sleeved washer 34 positioned between the top washer 108 and baseplate, and also between the bottom washer 110 and securement nut 112.

It is noted that the employment of the non-metal washer 42 is optional as a means to adjust the rebound and pre-load characteristics of the truck 100 as noted previously. Further, the device 10 can alternatively be employed with the cupped base 12 having a diameter of one of the planar annular surfaces 25 sized with a diameter specifically to match that of the first surface 29 of a sleeved washer 34 as opposed to the universal washer 20 which will accept a variety of sizes.

In other less preferred modes of the device 10, the device 10 and cupped base washer 12 and sleeved washer 34 may only be employed against the top bushing 108, and a conventional cupped washer with smooth surfaces can be used to secure the bottom bushing 110.

However, in modes of the invention where the device 10 is only employed on the top bushing 108, a cap component 46 is provided to secure the bottom bushing 110 in between the bushing 110 and nut 112. As shown in FIGS. 10-13, the cap is preferably frustoconical in shape and includes an axial passage 48 and engagement surface having one or a plurality of gripping ribs 50.

It is noted that the device 10 is essentially employable in a plurality of varying combinations of the components previously disclosed, as deemed suitable by the user. Therefor the preferred as used mode in FIG. 9 is provided merely as an example, and should not be considered limiting in any manner.

This invention has other applications, potentially, and one skilled in the art could discover these. The explication of the features of this invention does not limit the claims of this application; other applications developed by those skilled in the art will be included in this invention.

It is additionally noted and anticipated that although the device is shown in its most simple form, various components and aspects of the device may be differently shaped or slightly modified when forming the invention herein. As such those skilled in the art will appreciate the descriptions and depictions set forth in this disclosure or merely meant to portray examples of preferred modes within the overall scope and intent of the invention, and are not to be considered limiting in any manner.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A skateboard bushing securement apparatus, employable in combination with a skateboard truck assembly having a hanger in a sandwiched engagement between a first side of a top bushing and first side of a bottom bushing where a second side of said top bushing abuts a base plate, and where a kingpin engaged at a first end through said base plate axially communicates through said top bushing, said hanger, and exits at a second side of said bottom bushing, for engagement at a distal end to a configuration in an as-used position, to a nut, said bushing securement apparatus comprising:

a first base washer having a first side opposite a second side and having a central aperture communicating therebetween;

an annular ring portion projecting away from a perimeter edge of said second side, said annular ring portion having an inside edge defining an interior perimeter of a cavity defined by an area between said annular ring portion and said second side;

a first sleeve washer having a first surface and a second surface and having a central passage communicating therebetween;

a sidewall communicating between said first surface and second surface of said first sleeve washer and defining a perimeter thereof;

said perimeter of said first sleeve washer sized smaller than an interior perimeter of said cavity of said first base washer;

said first surface of said first sleeve washer positionable during an as-used configuration of said securement apparatus, in a communication against an area of said second surface of said first base washer within said cavity;

an annular sleeve portion projecting in a direction away from both said first surface and second surface of said first sleeve washer;

said annular sleeve portion having an interior wall surface having a perimeter substantially equal to a perimeter of said central passage;

said annular sleeve portion having an exterior wall surface opposite said interior wall surface, said exterior wall surface having an exterior circumference; and said interior perimeter of said cavity of said first base washer sized equal to or slightly less than a circumference of said top bushing, whereby with said securement apparatus in said as-used position, with said kingpin communicating through said base plate, said central aperture of said first base washer, said central passage of said sleeve washer and an axial inside cavity of said top bushing, said inside edge of said annular ring portion contacts a portion of said circumference of said top bushing at a first end thereof, and said annular sleeve portion projects into said axial cavity with said exterior wall surface adjacent a wall defining said axial cavity of said top bushing.

2. The bushing securement apparatus of claim 1, additionally comprising:

a second base washer having a first side opposite a second side and having a central aperture communicating therebetween;

an annular ring portion projecting away from a perimeter edge of said second side of said second base washer, said annular ring portion having an inside edge defining an interior perimeter of a cavity defined by an area between said annular ring portion and said second surface of said second base washer;

a second sleeve washer having a first surface and a second surface and having a central passage communicating therebetween;

a sidewall communicating between said first surface and second surface of said sleeve washer and defining a perimeter of said second sleeve washer;

said perimeter of said second sleeve washer sized smaller than said interior perimeter of said cavity of said second base washer;

said first surface of said second sleeve washer positionable during an as-used configuration of said securement apparatus, in a communication against an area of said second surface of said second base washer within said cavity;

an annular sleeve portion projecting in a direction away from both said first surface and second surface of said second sleeve washer;

said annular sleeve portion having an interior wall surface having a perimeter substantially equal to a perimeter of said central passage of said second sleeve washer;

said annular sleeve portion having an exterior wall surface opposite said interior wall surface, said exterior wall surface having an exterior circumference; and said interior perimeter of said cavity of said second base washer sized equal to or slightly less than a circumference of said bottom bushing, whereby with said securement apparatus in said as-used position, with said kingpin communicating through said central aperture of said first base washer, said central passage of said first sleeve washer, and said central aperture of said second base washer and said central passage of said second sleeve washer, and through an axial cavity of said top bushing, and an axial cavity of said bottom bushing;

said interior edge of said annular ring portion of said second base washer contacts a portion of said circumference of said bottom bushing at a first end thereof, and said annular sleeve portion of said second sleeve washer projects into said axial cavity of said second bushing, with said exterior wall surface adjacent a wall defining said axial cavity of said bottom bushing.

3. The bushing securement apparatus of claim 2, additionally comprising:

a plurality of stepped annular surfaces formed in said second side of said first base washer within said cavity;

said annular surfaces each in a different elevation within said cavity;

each said stepped annular surface having a respective diameter;

a plurality of stepped annular surfaces formed in said second side of said second base washer within said cavity thereof;

said annular surfaces each in a different elevation within said cavity of said second base washer;

each said stepped annular surface in said cavity of said second base washer, having a respective diameter;

said second sleeve washer chooseable from a plurality of said second sleeve washers each having a different respective perimeter sized to engage upon a respective one of said stepped annular surfaces of said second base washer;

said first sleeve washer chooseable from a plurality of said first sleeve washers each having a different respective perimeter sized to engage upon a respective one of said stepped annular surfaces of said first base washer;

whereby either or both of said sleeve washer and said second sleeve washer is respectively positionable closer to or further from said first bushing and said second bushing, by choosing a said first sleeve washer or second sleeve washer from a respective said plurality thereof, sized to engage upon said one of said stepped annular surfaces respectively of said first sleeve washer or said second sleeve washer.

4. The bushing securement apparatus of claim 2, additionally comprising:

a plurality of annular ribs having higher central areas declining to lower side edges, said annular ribs formed on said first surface of said first sleeve washer in concentric circles surrounding said annular sleeve portion thereof; and a plurality of annular ribs having higher central areas declining to lower side edges, said annular ribs formed on said first surface of said second sleeve washer in concentric circles surrounding said annular sleeve portion thereof.

5. The bushing securement apparatus of claim 1, additionally comprising:

a plurality of stepped annular surfaces formed in said second side of said first base washer within said cavity;

said annular surfaces each in a different elevation within said cavity;

each said stepped annular surface having a respective diameter;

said first sleeve washer chooseable from a plurality of said first sleeve washers each having a different respective perimeter sized to engage upon a respective one of said stepped annular surfaces, whereby said sleeve washer is positionable closer to or further from said first bushing by choosing a said first sleeve washer from said plurality to engage upon said one of said stepped annular surfaces.

6. The bushing securement apparatus of claim 1, additionally comprising:

a plurality of annular ribs having higher central areas declining to lower side edges, said annular ribs formed on said first surface of said first sleeve washer in concentric circles surrounding said annular sleeve portion thereof.

7. A skateboard truck assembly comprising:

a hanger in a sandwiched engagement between a first side of a top bushing and first side of a bottom bushing;

a baseplate proximate to a second side of said top bushing;

a first base washer having a first side opposite a second side and having a central aperture communicating therebetween;

an annular ring portion projecting away from a perimeter edge of said second side of said first base washer, said annular ring portion having an inside edge defining an interior perimeter of a cavity defined by an area between said annular ring portion and said second surface;

a first sleeve washer having a first surface and a second surface and having a central passage communicating therebetween;

a sidewall communicating between said first surface and second surface of said first sleeve washer and defining a perimeter thereof;

said perimeter of said first sleeve washer sized smaller than said interior perimeter of said cavity of said first base washer;

said first surface of said first sleeve washer communicating against an area of said second surface of said first base washer within said cavity;

a first annular sleeve portion of said first sleeve washer projecting in a direction away from both said first surface and second surface of said first sleeve washer;

said first annular sleeve portion having an interior wall having a perimeter substantially equal to a perimeter of said central passage of said first sleeve washer;

said first annular sleeve portion having an exterior wall surface opposite said interior wall surface, said exterior wall surface having an exterior circumference; and said interior perimeter of said cavity of said first base washer sized equal to or slightly less than a circumference of said top bushing, whereby with a kingpin communicating through said baseplate, said central aperture of said first base washer, said central passage of said first sleeve washer and an axial cavity of said top bushing, said interior edge of said annular ring portion of said first base washer contacts a portion of said circumference of said top bushing at a first end thereof, and said annular sleeve portion of said first sleeve washer projects into said axial cavity of said top bushing with said exterior wall surface adjacent a wall defining said axial cavity of said top bushing.

8. The skateboard truck assembly of claim 7, additionally comprising:

a second base washer having a first side opposite a second side and having a central aperture communicating therebetween;

a second annular ring portion projecting away from a perimeter edge of said second side of said second base washer, said second annular ring portion having an inside edge defining an interior perimeter of a cavity defined by an area between said second annular ring portion and said second surface of said second base washer;

a second sleeve washer having a first surface and a second surface and having a central passage communicating therebetween;

a sidewall communicating between said first surface and second surface of said second sleeve washer and defining a perimeter of said second sleeve washer;

said perimeter of said second sleeve washer sized smaller than said interior perimeter of said cavity of said second base washer;

said first surface of said second sleeve washer positionable against an area of said second surface of said second base washer within said cavity thereof;

a second annular sleeve portion projecting in a direction away from both said first surface and second surface of said second sleeve washer;

said second annular sleeve portion having an interior wall surface having a perimeter substantially equal to a perimeter of said central passage of said second sleeve washer;

said second annular sleeve portion of said second sleeve washer having an exterior wall surface opposite said interior wall surface, said exterior wall surface having an exterior circumference; and said interior perimeter of said cavity of said second base washer sized equal to or slightly less than a circumference of said bottom bushing, whereby with said kingpin communicating through said central aperture of said first base washer, said central passage of said first sleeve washer, and said central aperture of said second base washer and said central passage of said second sleeve washer, and through an axial cavity of said top bushing, and an axial cavity of said bottom bushing, said interior edge of said second annular ring portion of said second base washer contacts a portion of said circumference of said bottom bushing at a first end thereof, and said second annular sleeve portion of said second sleeve washer projects into said axial cavity of said second bushing, with said exterior wall surface thereof adjacent a wall defining said axial cavity of said bottom bushing.

9. The skateboard truck assembly of claim 8, additionally comprising:

a first plurality of annular ribs having higher central areas declining to lower side edges, said first plurality of annular ribs formed on said first surface of said first sleeve washer in concentric circles surrounding said first annular sleeve portion thereof; and a second plurality of annular ribs having higher central areas declining to lower side edges, said second plurality of annular ribs formed on said first surface of said second sleeve washer in concentric circles surrounding said second annular sleeve portion thereof.

10. The skateboard truck assembly of claim 9, additionally comprising:

a first planar polymeric washer positioned in between said second side of said first base washer and said first side of said first sleeve washer; and a second planar polymeric washer positioned in between said second side of said second base washer and said first side of said second sleeve washer.

11. The skateboard truck assembly of claim 7, additionally comprising:

a plurality of annular ribs having higher central areas declining to lower side edges, said annular ribs formed on said first surface of said first sleeve washer in concentric circles surrounding said first annular sleeve portion thereof.

12. The skateboard truck assembly of claim 11, additionally comprising:

a planar polymeric washer positioned in between said second side of said first base washer and said first side of said first sleeve washer.

* * * * *